United States Patent [19]

Bushnell, Jr.

[11] 4,390,080

[45] Jun. 28, 1983

[54] PORTABLE LIFT WITH LADDER

[76] Inventor: Sherman W. Bushnell, Jr., 1214 E. Hamlin St., Seattle, Wash. 98102

[21] Appl. No.: 228,679

[22] Filed: Jan. 26, 1981

[51] Int. Cl.[3] ..... E06C 5/20

[52] U.S. Cl. ..... 182/115; 182/63; 182/127

[58] Field of Search ..... 182/141, 148, 127, 115, 182/116, 17, 63; 187/9 E, 11

[56] References Cited

U.S. PATENT DOCUMENTS

| | | | |
|---|---|---|---|
| 202,426 | 4/1878 | Evans | 182/207 |
| 369,148 | 8/1887 | Wright | 182/17 |
| 1,148,035 | 7/1915 | Miller | 182/17 |
| 3,112,010 | 11/1963 | Mihalik | 182/116 |
| 3,464,519 | 9/1969 | Whisler | 182/141 |
| 3,664,458 | 5/1972 | Sterns | 182/141 |
| 3,752,261 | 8/1973 | Bushnell | 182/141 |
| 4,015,686 | 4/1977 | Bushnell | 182/148 |

*Primary Examiner*—Reinaldo P. Machado
*Attorney, Agent, or Firm*—Seed, Berry, Vernon & Baynham

[57] ABSTRACT

A multi-stage extensible tower on a wheeled base with a platform at the top has an extensible multi-sectioned ladder which slopes downwardly uniformly from the platform when the tower and ladder are in extended position. When the tower and ladder are in lowered, retracted position, the ladder sections have different slopes from one another. Outriggers are provided on the base which have a retracted position preventing extension of the tower. The platform has a fence which can be swung down level with the platform for conditions of reduced overhead clearance while the unit is being moved.

12 Claims, 6 Drawing Figures

FIG. 2
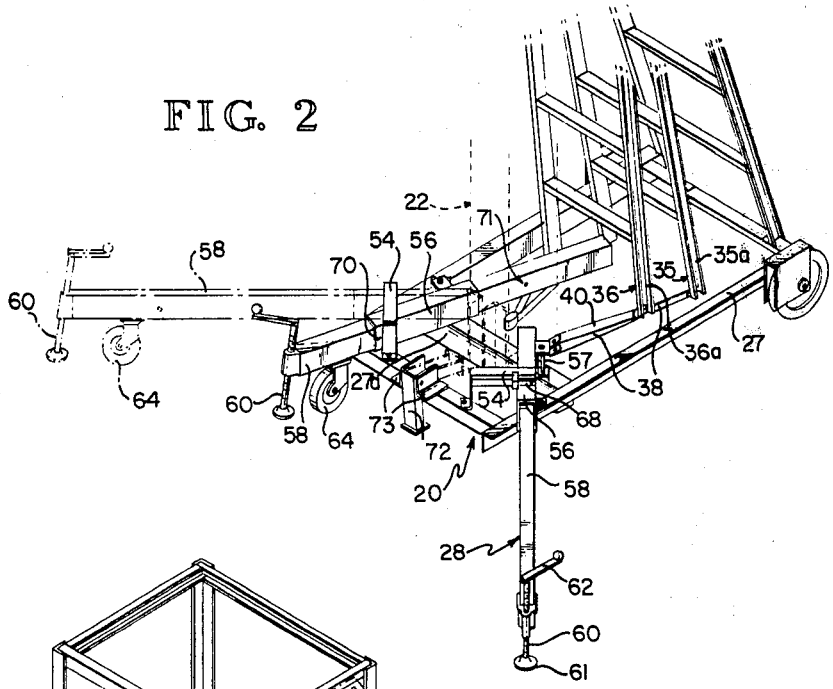
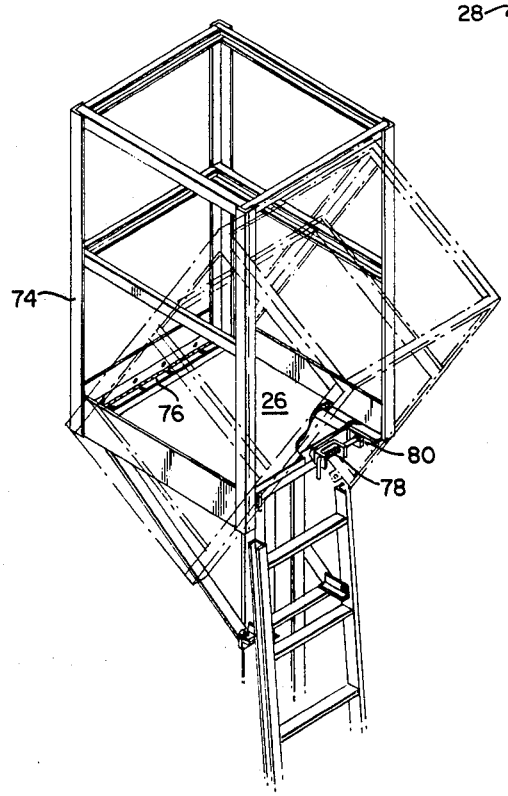
FIG. 3

FIG. 6
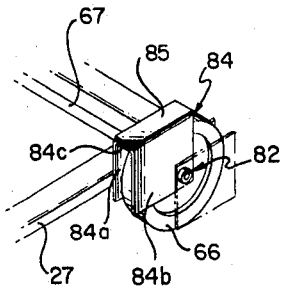
FIG. 4
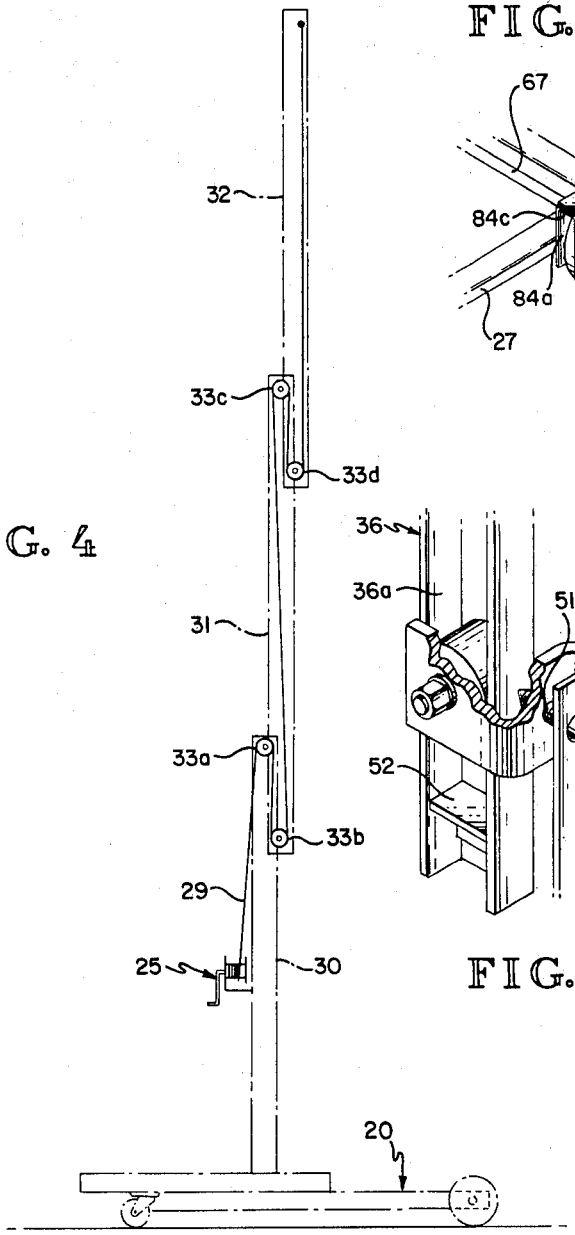
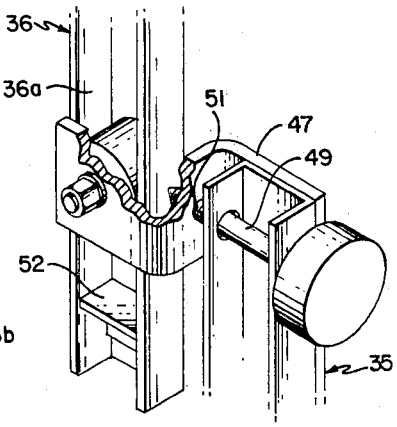
FIG. 5

PORTABLE LIFT WITH LADDER

DESCRIPTION

Technical Field

The present invention relates to portable, extensible lifts having a work platform at the top, and, more particularly, to such a lift in which there is access to the platform.

Background Art

Various portable units with adjustable-height work platforms are in use in construction and maintenance jobs. For maximum utility, these units should be stable for safety in use and yet should be adapted to be easily moved about on a job site and from one job site to another. It is also preferred that they be compact enough to be wheeled through doorways.

Although lift units of the type described can be used to raise a worker and/or materials to the desired working height, it is also preferred that there be easy and safe ladder access to the work platform. Various ladder arrangements have been use, but such have not provided a sturdy, compact ladder sloped throughout its length when the work platform is in raised position. Also, there has been a need for a compact extensible mast and extensible ladder arrangement in which maximum platform height with a fenced platform can be achieved for passage through a doorway when the mast and ladder are retracted. It is important that such needs be filled while at the same time providing adequate outrigger stability in a convenient-to-use manner and without sacrificing mobility when the unit is to be moved on the work site.

DISCLOSURE OF THE INVENTION

The present invention provides an improved portable lift meeting the above-discussed needs and requirements.

In accordance with the invention, a multistage, extensible mast on a wheeled base has means for extending and retracting the mast to raise and lower a fenced platform at its upper end. To gain access to the platform when raised, a multi-sectioned, sloped ladder is provided which extends and retracts with the mast. The ladder has its upper section fixed in sloped position on the top stage of the mast, whereas the rest of the sections are swing-mounted at their lower ends and have a slide interfit at their upper ends with the adjoining ladder section. When the ladder is extended, the sections thereof partly overlap and are held in parallel sloped position by tightening screw clamps.

The fence for the platform can be swung downwardly to lower the height of the lift accordingly when there is an overhead clearance problem when the lift is being moved by wheeling it along. The wheels include casters on outrigger arms that may be extended in reach or retracted. When retracted, the outrigger arms prevent the mast from being extended. The outrigger arms also have screw jacks to lift the casters form ground engagement. To free the outriggers of load when they are to be extended or retracted, a cam leg is provided which will lift the casters above the ground level when the cam leg is swung into ground engagement. Wheels are provided on the base opposite the outriggers and these can be deactivated by anti-roll plates which can be swung on the wheel axle to a position beneath the wheels.

Various means can be used to extend and retract the mast. For purposes of example, a cable-reeving system is used with the cable being wound on a hand winch mounted on the lower stage of the mast.

BRIEF DESCRIPTION OF THE DRAWINGS

FIG. 2 is a top perspective view of the base assembly, partly broken away, with one of the outrigger arms extended and th other retracted;

FIG. 3 is a detail perspective view of the platform and fence assembly;

FIG. 4 is a schematic elevational view showing the cable reeving;

FIG. 5 is a detail perspective view showing the interconnection between the top portion of the intermediate ladder section and the bottom portion of the top ladder section; and FIG. 6 is a detail perspective view of an anti-roll device for the rear wheels.

BEST MODE FOR CARRYING OUT THE INVENTION

Figure 1:
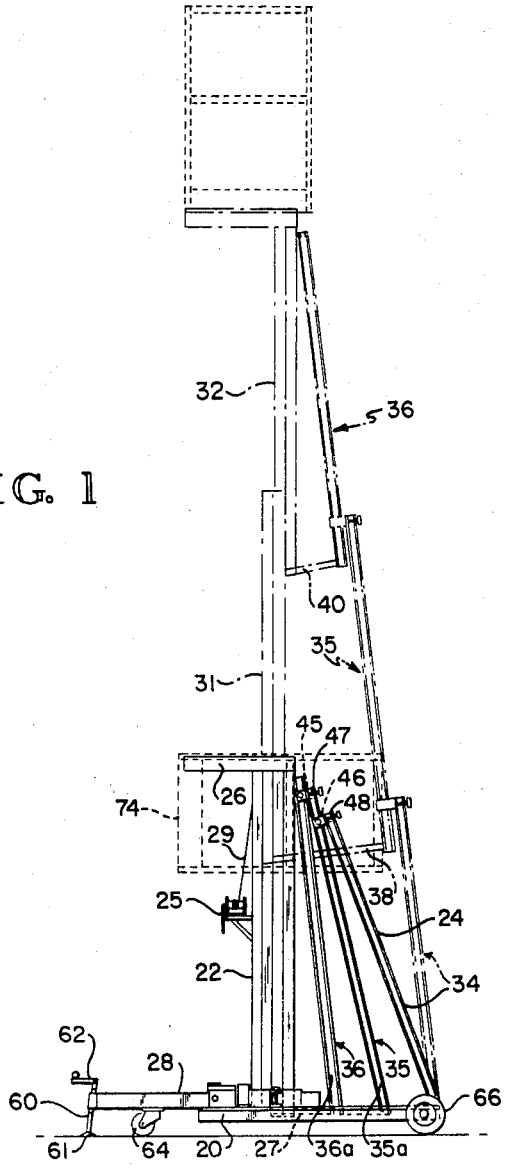
FIG. 1 is a side elevational view of a lift according to the present invention, shown in the lowered position in full lines and the raised position in phantom.

Referring to the drawing, it is seen that the lift made according to the invention has a mobile base assembly 20 on which are mounted, front and back, a telescopic, multistage tower 22 and an extensible ladder 24. The tower 22 has a winch 25 at the front and a fenced platform 26 at the top thereof, and the base assembly 20 has a rectangular frame 27 with a cross-member 27*a* near the front, on which the tower 22 is fixed. A pair of outriggers 28 are at the front of the base assembly 20.

For purposes of example, the tower 22 has been illustrated as having a three-stage mast comprising a stationary bottom mast section 30 rigidly mounted on the cross-member 27*a*, and intermediate mast section 31 slidably mounted on the bottom section 30, and a top mast section 32 in turn slidingly mounted on the intermediate section 31. Additional like intermediate mast sections can be provided if additional stages are desired for the tower 22.

The sections 30–32 of the tower 22 are preferably constructed and roll-mounted relative to one another in front-to-back relationship in the same manner as the sections of the multistage mast shown in my prior U.S. Pat. No. 4,015,686. It is also preferred to use the same type of cable-reeving system shown in that patent for extending and retracting the mast by operation of the winch 25 mounted on the front of the bottom mast section 30 and to provide the automatic safety system of the patent for locking the mast sections together in case of cable failure.

The reeving for the cable 29 wound on the winch 25 is illustrated schematically in FIG. 4. A series of four sheaves 33*a, b, c* and *d* are provided over which the cable 29 passes consecutively from the winch 25 to an anchor connection near the upper end of the top mast section 32. Sheave 33*a* is mounted at the top of the bottom mast section 30 and sheaves 33*b*,33*c* are mounted at the bottom and top, respectively, of the intermediate mast section 31. Sheave 33*d* is in turn mounted at the bottom of the top mast section 32. When the tower 22 is in its lowered, fully retracted position, the maximum amount of cable 29 is unwound from the winch 25. When the cable is then wound on the winch, the top mast section 32 will normally raise first, until a stop near the bottom of the top section 32 engages a stop near the top of the intermediate mast section 35. The intermediate section 35 then raises until a stop near its lower end engages a stop near the upper end of the bottom mast section 30. These stops are not shown in the drawing but are identical to those shown in my aforesaid prior patent. If the automatic safety system in such patent is not used, the sheaves 33*d* can be eliminated and the cable 29 dead-ended on the top mast section 32 near the bottom thereof rather than as previously indicated.

The ladder 24 has a respective section for each of the tower sections 30–32, namely, a bottom ladder section 34 pivotally mounted at its lower end on the rear of the base frame 27, an intermediate ladder section 35 pivotally connected at the bottom to the rear of a pair of braces 38 at the bottom of the intermediate mast section 31, and a top ladder section 36 connected at the bottom to the rear of a pair of rearwardly extending braces 40 at the bottom of the top mast section 32. The top ladder section 36 is also connected at the top to the top mast section 32 by way of angle brackets connected to a lateral cross-member 42 fixed to the top mast section a short distance beneath the platform assembly 26. Hence the top ladder section 36 is fixed in a rearwardly sloped position relative to the top mast section 32, whereas the other two ladder sections 34,35 are free to pivot fore and aft relative to their respective mast sections 30,31. The reason for this pivotal movement will be explained later.

The side rails of the ladder sections 34–36 are preferably laterally facing channels so that the side rails 35*a* and 36*a* of the intermediate and top ladder sections 35–36 comprise tracks for respective rollers 45–46. Rollers 45 have their axles 45*a* mounted on the forward leg of a respective forwardly projecting, S-shaped bracket 47 fixed at the rear to the upper end of the corresponding side rail 35*a* of the intermediate ladder section 35. Similarly, rollers 46 have their axles mounted on the forward leg of a respective forwardly projecting, S-shaped bracket 48 mounted at the rear to the upper end of the corresponding side rail 35*a* of the bottom ladder section 34. Passing through holes in the channel legs of the side rails 35*a*,36*a* and a threaded hole 51 in the center webs of the S-shaped brackets 47,48 are respective clamping bolts 49,50, each having a turning handle as its head. Each bolt 49,50 has a threaded portion screwed through the respective hole 51. The purpose of the bolts 49,50 is to bear, when tightened, against the opposed back faces of the ladder side rails to thereby stiffen the ladder 24 when the tower 22 is extended to the desired height.

At the lower end of the side rails 36*a* of the top ladder section 36, stops 52 are provided to limit the downward travel of the rollers 45 in these side rails as the top ladder section moves upwardly with the top mast section as the tower is raised. The stops 52 are located so that as the top mast section 32 reaches the limit of its upward travel relative to the intermediate mast section 31, the rollers 45 engage the stops 52, whereby lifting of the intermediate ladder section 35 by the top ladder section 36 commences at the same moment as upward movement of the intermediate mast section 31. This arrangement makes it unnecessary for the braces 38 at the bottom of the intermediate ladder section 35 to be adapted to take any significant portion of the vertical loads on the ladder.

It will be noted that as the rollers 45 move downwardly in the side rails 36*a* responsive to upward movement of the top mast section 32 and the ladder section 36 as a unit, the slope of the intermediate ladder section 35 gradually becomes steeper until it preferably reaches substantially the same slope as the top ladder section. This change in slope is permitted by way of the pivotal connection between the bottom of the intermediate ladder section 35 and the rear end of the intermediate braces 38. It will be appreciated that the lengths of these braces 38 and the shorter top braces 40 are made such that the top and intermediate ladder sections will overlap in substantially parallel relation when the top mast section 32 is fully extended. Similarly, the pivotal connection of the lower end of the bottom ladder section 34 to the base frame 27 permits this section to likewise assume a steeper slope as the rollers 46 at its upper end travel down the side rails 35*a* responsive to upward travel of the intermediate ladder section 35 with the intermediate mast section 31 during the raising thereof. Hence, when the tower 22 and the ladder 24 are both fully extended, the three ladder sections 34–36 will be in overlapping, substantially parallel, sloped relationship. The ladder 24 then can be made stiffened by tightening bolts 49,50.

The base frame 27 has a pair of U-shaped retaining brackets 54 diagonally bridging its front corner portions to receive elongated outrigger sleeves 56 of square cross-section which are swing-mounted on the top of the cross-member 27*a* by vertical bolts 57. Tubular outrigger arms 58 are slidably mounted in these sleeves 56 and have screw jacks 60 mounted at their outer ends with ground-engaging pads 61 at their lower end and crank handles 62 at their upper end. Adjacent these jacks 60 are casters 64 which support the forward end of the base assembly 20 when moving the lift is desired. These casters 64 are complemented by a pair of wheels 66 on a cross-axle 67 at the rear of the base frame 27. Pivoted locking hooks 68 are provided on the central bridge portion of the retaining brackets 54 to keep the outrigger sleeves 56 in outwardly swung, diverging position when the hooks 68 are dropped into a generally horizontal position. Spring-loaded locking pins 70 are perferably provided on the outrigger sleeves 56 to interfit with respective holes 71 in the outrigger arms 58 when they are in their extended and retracted positions. It will be noted that when the tower 22 is in the lowered position and the outrigger arms 58 are fully retracted, they project inwardly of the base frame 27 above the cross-member 27*a* to a position directly over the braces 35,36 on the lower ends of the top mast section. This arrangement prevents the sections of the tower 22 from extending until the outrigger arms 58 have been shifted to reach forwardly into their maximum supporting position. When the outrigger arms 58 are in their retracted position, the base assembly 20 will normally be supported at the front by the casters 64 and at the rear by the wheels 66.

A cam leg 72 is pivotally mounted between a pair of forwardly projecting fork arms 73 at the front of the base frame 27 to raise the casters 64 out of ground engagement when the cam leg is rocked downwardly into ground engagement and while the lift is being rolled forwardly on the casters 64 and rear wheels 66. This takes the load from the outrigger arms so that they can be more easily pulled forwardly through the sleeves to clear the bottom mast section 30 and so that the sleeves can then e swung outwardly on the pivot bolts 56 until they engage the outer extents of the retaining brackets 54. The sleeves are then locked by the hooks 68 in diverging position, and the outrigger arms are locked in forwardly extended diverging position by the locking pins 70 on the sleeves 56. Following this, the handles 62 on the jackscrews 60 are turned to lower the pads 61 into ground engagement and take the load off the cam leg 72 while the caster wheels remain raised off the ground. The cam leg 72 is then swung upwardly into inactive position.

It is preferred that the lift of the invention be capable of being wheeled through a doorway when the tower is in lowered, retracted position. However, since the platform 26 should preferably have a fence 74 when occupied, and height of the lift preferably should not be sacrificed for the fence, there is a need to have an arragement for conveniently lowering the fence when it is desired to move the lift through a doorway. Hence the fence 74 is hinged at 76 along its bottom front edge to the front of the platform 26 so that the fence can swing downwardly in the rearward direction until the front frame portions of the fence engage the top of the platform. To make this possible, the back of the fence is clear of framework except for the upper fence rail. To hold the fence 74 in upright position, a pair of spring-loaded slide bolts 78 are provided at the rear of the platform which move laterally outward to fit into keeper holes 80 presented by downwardly extending ears near the lower rear corners of the fence frame.

Directing attention to FIG. 6, it is seen that the rear wheels 66 are each preferably provided with an anti-skid device 84 pivotally mounted on the axle 67. The device 84 is generally U-shaped, providing cheek plates **84*a*, 84*b* on opposite sides of the wheel and a central web 84*c* on which is mounted an anti-skid pad 85. When the device 84 is in inactive position, the web 84*c* is above the wheel. To activate the device 84, it is swung down rearwardly into ground engagement, and then the lift unit is rolled rearwardly, thereby causing the respective wheel 66 to move into an inactive position over the inner face of the web 84*c* and the anti-skid pad 85** to rest flat against the ground surface.

Those skilled in the art could make many modifications to the preferred embodiment described and shown without departing from the general concept of this invention. Therefore, this invention should not be limited unless it is necessary to do so because of the teachings of the prior art or the fair reading of the appended claims.

I claim:

1. A lift comprising:

a base, a multistage extensible mast mounted on the base, said mast having a top stage, and intermediate stage, and a bottom stage, a platform on the mast, a multi-sectioned extensible ladder to give access to said platform, said ladder having a top sloped section fixed to said top stage, an intermediate sloped section having a sliding fit at the upper end with said top section, and a bottom sloped section having a sliding fit at its upper end with said intermediate section, said bottom section being pivotally connected at its lower end to said base, and said intermediate section being pivotally mounted at its lower end to a brace connected to said intermediate stage of the mast, means for extending said mast, and means for extending said ladder responsive to extension of said mast.

2. A lift according to claim 1 in which screw means are provided for locking said ladder sections together in overlapping parallel relation when the ladder is extended.

3. A lift according to claim 1 in which a fence is swing-mounted on said platform and has releasable locking means for holding the fence in upright position surrounding the platform, said fence being arranged to swing downwardly on opposite sides of said mast when said locking means is released.

4. A lift according to claim 1 in which said top section of the ladder has side rails serving as tracks, and rollers is said tracks carried at the upper end of the adjoining ladder section.

5. A lift according to claim 4 in which said adjoining ladder section is pivotally connected near its lower end relative to the respective stage of the mast in spaced relation to the mast such as to give said adjoining ladder section less slope when the ladder is retracted than when extended.

6. A lift according to claim 1 in which each of said ladder sections is sloped when the ladder is extended or retracted, and each ladder section below the top section is free to swing about its lower end.

7. A lift according to claim 6 in which all of the ladder sections other than the top one have less slope when the ladder is fully retracted than when it is fully extended.

8. A lift according to claim 1 in which clamping means are provided on said ladder to stiffen the ladder when it is in extended position.

9. A lift comprising:

a base, a multistage extensible mast mounted on the base, a platform on the mast, a multi-sectioned extensible ladder to give access to said platform, said ladder having a section for each stage of the mast and the top section of the ladder being connected to the top stage of the mast, means for extending said mast, means for extending said ladder responsive to extension of said mast, a brace extending between said top section of the ladder and the top stage of the mast near the lower end thereof, and an outrigger slidably mounted on said base, said outrigger having a retracted position overlying said brace, thereby preventing extension of said mast and ladder, and having an extended position clear of said brace.

10. A lift comprising:

a base, a multistage extensible mast having a top stage, a bottom stage mounted on the base, and at least one intermediate stage, means for extending the mast, a platform on the top stage, a multi-sectioned extensible ladder giving access to the platform, said ladder having a section for each stage of the mast, the top section of the ladder being connected to the top stage in fixed, sloped relation thereto, the bottom section of the ladder being pivotally connected to the base, and each of the remaining ladder sections being pivotally interconnected at its lower end in spaced relation to the respective mast stage, and roller means slidably and pivotally interconnecting the ladder sections, the ladder sections below the top section having the same slope as the top section when the ladder is fully extended and having successively lesser slopes when the ladder is retracted.

11. A lift according to claim 10 in which said stages of the mast are located behind one another, with the top stage rearmost, and said sections of the ladder are behind the mast and overlap one another, with the bottom ladder section rearmost, said ladder sections always being sloped relative to the mast, with each ladder section having a different slope when the ladder is retracted and each having substantially the same slope when the ladder is extended.

12. A lift according to claim 10 in which stop means are provided near the lower end of each ladder section other than the bottom two ladder sections to cooperate with said roller means to keep the ladder sections connected together when the mast is extending.

* * * * *